US005541041A

United States Patent [19]

Haye

[11] Patent Number: 5,541,041

[45] Date of Patent: Jul. 30, 1996

[54] STABILIZED PEROXIDE BLEACHING SOLUTIONS CONTAINING MULTIPLE CHELATING LIGANDS AND THEIR USE FOR PROCESSING OF PHOTOGRAPHIC ELEMENTS

[75] Inventor: Shirleyanne E. Haye, Rochester, N.Y.

[73] Assignee: Eastman Kodak Company, Rochester, N.Y.

[21] Appl. No.: 423,257

[22] Filed: Apr. 17, 1995

[51] Int. Cl.[6] ..... G03C 7/00; G03C 5/44; G03C 5/42

[52] U.S. Cl. ..... 430/393; 430/430; 430/461; 430/943

[58] Field of Search ..... 430/393, 430, 430/461, 943, 488, 491, 490, 493

[56] References Cited

U.S. PATENT DOCUMENTS

| | | | |
|---|---|---|---|
| 2,168,181 | 8/1939 | Ulrich et al. | 430/461 |
| 4,277,556 | 7/1981 | Koboshi et al. | 430/393 |
| 4,301,236 | 11/1981 | Idota et al. | 430/393 |
| 4,454,224 | 6/1984 | Brien et al. | 430/393 |
| 5,250,401 | 10/1993 | Okada et al. | 430/393 |
| 5,316,898 | 5/1994 | Ueda et al. | 430/393 |

FOREIGN PATENT DOCUMENTS

| | | | |
|---|---|---|---|
| 0199604 | 10/1986 | European Pat. Off. . | |
| 0270217 | 6/1988 | European Pat. Off. . | |
| 428101A1 | 5/1991 | European Pat. Off. . | |
| 0532003 | 3/1993 | European Pat. Off. . | |
| 0553569 | 8/1993 | European Pat. Off. . | |
| 0567126 | 10/1993 | European Pat. Off. . | |
| 4-349109 | 12/1992 | Japan . | |
| 5-72695 | 3/1993 | Japan . | |
| 6-123950 | 5/1994 | Japan | 430/460 |
| 92/07300 | 4/1992 | WIPO . | |
| 93/11459 | 6/1993 | WIPO . | |

*Primary Examiner*—Charles L. Bowers, Jr.
*Assistant Examiner*—J. Pasterczyk
*Attorney, Agent, or Firm*—J. Lanny Tucker

[57] ABSTRACT

Color photographic elements are bleached after exposure and development by using a peroxide bleaching solution. This solution comprises a peroxide bleaching agent, chloride ions in an amount of at least 0.35 mol/l, a first acid which is an organic phosphonic acid and a second acid which is a polyaminocarboxylic acid having one or more secondary amines at a pH of 8 to 11. The bleaching solution is stabilized by the presence of the two acids.

21 Claims, No Drawings

STABILIZED PEROXIDE BLEACHING SOLUTIONS CONTAINING MULTIPLE CHELATING LIGANDS AND THEIR USE FOR PROCESSING OF PHOTOGRAPHIC ELEMENTS

FIELD OF THE INVENTION

The present invention relates generally to the processing of color photographic elements. More particularly, it relates to the use of stabilized peroxide bleaching solutions comprising a certain amount of chloride ion and two distinct sequestering acids. The compositions and the methods for their use in photography are the subject of this invention.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions that are more compatible with the environment, and thus it is desirable to reduce or avoid the use of ferric complex bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiols that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. Nos. 4,277,556 (Koboshi et al), 4,301,236 (Idota et al), 4,454,224 (Brien et al), 4,717,649 (Hall et al), and WO-A-92/01972 (published Feb. 6, 1992).

In addition, WO-A-92/07300 (published Apr. 30, 1992) and EP 0 428 101A1 (published May 22, 1991) describe peroxide compositions for bleaching high chloride emulsions. These compositions comprise up to 0.3 mole of chloride ions per liter of solution and have a pH in the range of 5 to 11. These particular bleaching solutions, however, cause vesiculation in the processed element.

WO-A-93/11459 describes peroxide bleaching solutions that include two or more water-soluble sequestering agents for complexing with transition metals. These solutions appear to be suitable for use with low silver paper materials.

Despite all of the efforts of researchers in the art, no peroxide bleaching composition has been commercialized because of various problems including vesiculation (that is, blistering from evolution of oxygen), poor bleaching efficiency and solution instability.

Improved peroxide bleaching solutions for both low and high chloride emulsions are described in copending and commonly assigned U.S. Ser. No. 08/391,805, filed Feb. 21, 1995 by Haye, O'Toole and Ballou, and U.S. Ser. No. 08/391,993, filed on Feb. 21, 1995 by Haye, Marrese and Bonner. These applications describe the improvements achieved in bleaching efficiency and speed and reduced vesiculation obtained by including at least 0.35 mole of chloride ions per liter of solution.

In addition, copending and commonly assigned U.S. Ser. No. 08/422,468, filed on even date herewith by Haye and Reyes, and entitled STABILIZED PEROXIDE BLEACHING SOLUTIONS AND THEIR USE FOR PROCESSING OF PHOTOGRAPHIC ELEMENTS, describes peroxide bleaching solutions having two or more sequestering agents, one of which is a pyridinecarboxylate, and the other is an organic phosphonic acid or salt thereof. These solutions have improved bleaching effectiveness and reduced vesiculation, but alternative stabilized compositions are desired.

SUMMARY OF THE INVENTION

The noted problems are solved with a method for processing a color photographic element comprising:

bleaching an imagewise exposed and developed color photographic element with a peroxide bleaching composition, the composition comprising:

a peroxide bleaching agent, chloride ions present in an amount of at least 0.35 mol/l, a first acid which is an organic phosphonic acid or a salt thereof, and a second acid that is a polyaminocarboxylic acid having at least one secondary amine at a pH of from about 8 to about 11, or a salt thereof.

This invention also provides a peroxide bleaching composition having a pH of from about 7 to about 13 and comprising:

a peroxide bleaching agent present in an amount of from about 0.15 to about 5 mol/l, chloride ions present in an amount of at least 0.35 mol/l, a first acid which is an organic phosphonic acid or a salt thereof, and a second acid that is a polyaminocarboxylic acid having at least one secondary amine at a pH of from about 8 to about 11, or a salt thereof.

The bleaching composition of this invention provides all of the advantages inherent in the compositions described in the noted copending applications described above, that is, efficient and rapid bleaching and reduced vesiculation. In addition, however, the composition of this invention has improved stability. That is, the loss in peroxide over time is considerably reduced. Thus, the composition has improved shelf life during shipping and storage.

These advantages are achieved by including in the solution a combination of two different water-soluble acids, each of which are known for different purposes (such as chelating with ferric ions). However, they have not been previously used in combination to stabilize peroxide bleaching solutions. Thus, the discovery that this combination of materials provides this effect in peroxide bleaching solutions is unexpected.

DETAILED DESCRIPTION OF THE INVENTION

Peroxide bleaching solutions of this invention contain a conventional peroxide bleaching agent including, but not limited to hydrogen, alkali and alkaline earth salts of peroxide, or a compound which releases or generates hydrogen peroxide. Such hydrogen peroxide precursors are well known in the art, and include for example, perborate, perphosphate, percarbonate, percarboxylate, and hydrogen peroxide urea. In addition, hydrogen peroxide can be generated in situ by electrolysis of an aqueous solution. Examples of peroxide bleaching solutions are described, for example, in *Research Disclosure*, publication 36544, pages 501–541 (Sep. 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Hydrogen peroxide is a preferred bleaching agent.

The amount of hydrogen peroxide (or its precursor) is generally at least 0.15 mol/l, and from about 0.15 to about 5 mol/l is preferred. The optimum amount will depend upon the type of photographic element being processed. For example, for color negative films that contain silver bromoiodide emulsions, more preferred amounts are from about 0.9 to about 3 mol/l. The more preferred amounts for silver bromoiodide emulsions are from about 1.45 to about 2.0 mol/l. For motion picture print films, the more preferred amount is from about 0.15 to about 1 mol/l, and most preferred amounts are from about 0.35 to about 0.6 mol/l. For photographic color papers, the preferred amounts would be from about 0.15 to about 3 mol/l.

Chloride ions can be supplied to the bleaching solution as part of a simple inorganic salt for example, sodium chloride, potassium chloride, ammonium chloride and lithium chloride. In addition, they can be supplied as organic complexes such as tetraalkylammonium chlorides. The preferred salts are potassium and sodium chlorides.

The chloride ion concentration is at least 0.35 mol/l, with from 0.35 to about 2 mol/l being preferred, and from 0.35 to about 1 mol/l being most preferred.

The bleaching solutions of this invention are quite simple, having four essential components: the peroxide bleaching agent, the chloride ions, and two distinct sequestering agents, as defined below. An optional and preferred component is a buffer.

The bleaching solution of this invention is alkaline, having a pH within the general range of from about 7 to about 13, with a pH of from about 8 to about 12 being preferred, and a pH of from about 9 to about 11 being most preferred. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium and potassium carbonates are preferred.

The amount of useful buffer or base would be readily apparent to one skilled in the art.

The first acid is an organic phosphonic acid or salt thereof. Generally such compounds are represented by the structure (I):

$$R^1N(CH_2PO_3M_2)_2$$

or (II):

$$R^2R^3C(PO_3M_2)_2$$

wherein $R^1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, σ-octamidobenzyl or β-phenethyl), a substituted or unsubstituted alkylaminoalkyl group (wherein the alkyl portion of the group is an defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, ρ-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, primidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R^2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_3M_2$ or $—CHR^4PO_3M_2$.

$R^3$ is hydrogen, hydroxyl, a substituted or unsubstituted alkyl group of 1 to 12 carbon atoms (defined above) or $—PO_3M_2$.

$R^4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4). Representative useful compounds are 1-hydroxyethylidene-1,1-diphosphonic acid, diethylenetriaminepentaphosphonic acid, ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, σ-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, σ-acetamidobenzylamine-N,N-dimethylenephosphonic acid, σ-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta(methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, or salts thereof.

Particularly useful are 1-hydroxyethylidene-1,1-diphosphonic acid, nitrilo-N,N,N-trimethylenephosphonic acid, diethylenetriamine-N,N,N',N",N"-penta(methylenephosphonic acid), or salts thereof. The first compound is most useful.

The amount of organic phosphonic acid used in the practice of the invention is at least about 0.0005 mol/l and generally up to about 0.03 mol/l. An amount of from about 0.0025 to about 0.012 mol/l is preferred.

The second acid is a polyaminocarboxylic acid that has at least one secondary amino group at a pH of from about 8 to about 11. The compound also has at least two carboxyl groups (polydentate), or their corresponding salts. Such acids can be bidendate, tridentate, tetradentate, pentadentate and hexadentate ligands. These acids must be water-soluble also, and are preferably biodegradable (defined below).

More specifically, these compounds include, but are not limited to, alkylenediaminetetracarboxylic acids having at least one secondary nitrogen atom, and alkylenediaminepolycarboxylic acids having at least one secondary nitrogen atom.

Representative useful classes of such acidic compounds are defined below in reference to structures (III)–(VII), although it should be recognized that the invention is not limited in practice to these compounds.

Thus, the compounds can have any of the following structures:

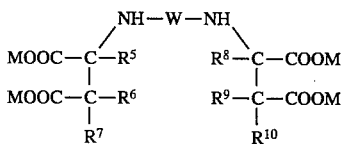

(III)

wherein $R^5$, $R^6$, $R^7$, $R^8$, $R^9$ and $R^{10}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), M is as defined above, W is a covalent bond or a divalent substituted or unsubstituted aliphatic linking group (defined below),

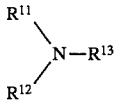

(IV)

wherein at least two of $R^{11}$, $R^{12}$ and $R^{13}$ are a carboxymethyl groups (or equivalent salts), and the third group is hydrogen,

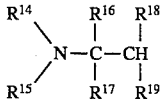

(V)

wherein one of $R^{14}$ and $R^{15}$ is hydrogen and the other is substituted or unsubstituted carboxymethyl group (or equivalent salts) or 2-carboxyethyl group (or equivalent salts), and $R^{16}$, $R^{17}$, $R^{18}$ and $R^{19}$ are independently hydrogen, a substituted or unsubstituted alkyl group of 1 to 5 carbon atoms (as defined above), hydroxy, carboxy, carboxymethylamino, or a substituted or unsubstituted carboxymethyl group (or equivalent salts), provided that only one of $R^{16}$, $R^{17}$, $R^{18}$ and $R^{19}$ is carboxy, carboxymethylamino, or a substituted or unsubstituted carboxymethyl group (or equivalent salts),

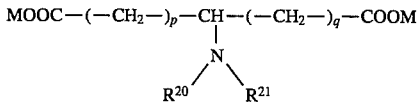

(VI)

wherein one of $R^{20}$ and $R^{21}$ is hydrogen and the other is a substituted or unsubstituted alkyl group of 1 to 5 carbon atoms (as defined above), substituted or unsubstituted hydroxyethyl group, substituted or unsubstituted carboxymethyl or 2-carboxyethyl group (or equivalent salts), M is as defined above, and p and q are independently 0, 1 or 2 provided that the sum of p and q does not exceed 2, or

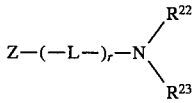

(VII)

wherein

Z represents a substituted or unsubstituted aryl group of 6 to 10 carbon atoms in the nucleus (as defined above) or a substituted or unsubstituted heterocyclic group having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl).

L is a divalent substituted or unsubstituted aliphatic linking group (defined below), one of $R^{22}$ and $R^{23}$ is hydrogen and the other is a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups that form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others that would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, carboxy, sulfo, sulfonato, thioalkyl, alkylcarbonamido, alkylcarbamoyl, alkylsulfonamido, alkylsulfamoyl, carbonamido, sulfonamido, sulfamoyl, amino, halo (such as chloro or bromo), sulfono (—$SO_2R$) or sulfoxo [—S(O)R] wherein R is a branched or linear alkyl group of 1 to 5 carbon atoms.

In reference to the foregoing structures (III)–(VII), preferred definitions of groups are as follows:

M is hydrogen, ammonium, lithium, sodium or potassium, $R^5$, $R^6$, $R^7$, $R^8$, $R^9$ and $R^{10}$ are independently hydrogen, hydroxy or methyl, W is a covalent bond or a substituted or unsubstituted alkylene group of 1 to 3 carbon atoms, one of $R^{14}$ and $R^{15}$ is carboxymethyl, $R^{16}$, $R^{17}$, $R^{18}$ and $R^{19}$ are independently hydrogen, carboxymethyl or carboxy, one of $R^{20}$ and $R^{21}$ is methyl or carboxymethyl, Z represents 2-pyridyl or 2-imidazolyl, L is substituted or unsubstituted alkylene of 1 to 3 carbon atoms, one of $R^{22}$ and $R^{23}$ is 2-carboxyethyl or carboxymethyl, and r is 1.

More preferred second acid compounds are N,N-ethylenediaminedisuccinic acid, N,N-ethylenediaminediacetic acid, and N-(2-carboxyethyl)aspartic acid.

Besides those acids specifically defined in the foregoing description, there is considerable literature that describes additional useful second acids, such as EPA 0 567 126 (Seki et al), U.S. Pat. Nos. 5,250,401 (Okada et al) and 5,250,402 (Okada et al), as long as the compounds have a secondary amino group at a pH of from about 8 to about 11.

The one of more second acids are present in the bleaching composition in an amount of at least about 0.0005 mol/l. Preferred amounts are from about 0.001 to about 0.05 mol/l, and more preferred amounts are from about 0.002 to about 0.01 mol/l.

Many of the first and second acids described herein are commercially available (such as from Dow Chemical Company or Sigma Chemical Company), or can be prepared by methods known to those skilled in the art.

Mixtures of each type of acid compound can be used if desired.

As used herein, the terms "biodegradable" or "biodegradability" refer to at least 80% decomposition in the standard test protocol specified in by the Organization for Economic Cooperation and Development (OECD), Test Guideline 302B (Paris, 1981), also known as the "Modified Zahn-Wellens Test".

As used herein in defining concentrations of reagents and times, the term "about" refers to ±20% of the indicated amount. In defining pH values, the term "about" refers to ±0.5 unit. In defining temperature, the term "about" refers to ±5° C.

The color photographic elements to be processed using the present invention can contain any of the conventional silver halide emulsions. They can be "high chloride" or "low chloride" emulsions, but preferably they are "high chloride" emulsions. Thus, other emulsions are also useful, including but not limited to, silver bromide, silver iodide, silver bromoiodide, silver chloroiodide, silver chlorobromide, silver bromochloroiodide and silver chlorobromoiodide. By "high chloride" emulsions is meant those having at least 50 mol % of chloride as the halide component of the emulsion grains. More preferably, they contain at least 90 mol % of chloride. "Low chloride" emulsions mean those having less than 30 mol % of chloride, and preferably less than 10 mol % of chloride. The high chloride emulsions contain substantially no iodide, meaning less than 5 mol % of iodide, and preferably no iodide.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure*, noted above. All types of emulsions can be used in the elements, including but not limited to, thin tabular grain emulsions, and either positive-working or negative-working emulsions. The elements can be either photographic film or paper elements.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Color developers are well known and described in many publications including Research Disclosure (noted above). In addition to color developer agents, the color developers generally contain a buffer (such as potassium carbonate), a sulfite, chelating agents, halide and one or more antioxidants as preservatives. There are many classes of useful antioxidants including, but not limited to, hydrazines and substituted or unsubstituted hydroxylamines. By substituted hydroxylamines is meant, for example, those having one or more alkyl or aryl groups connected to the nitrogen atom. These alkyl or aryl groups can be further substituted with one or more groups such as sulfo, carboxy, carbamoyl, sulfamoyl, hydroxy, alkoxy, and other groups known in the art which provide solubilizing effects. Examples of such hydroxylamines are described, for example, in U.S. Pat. Nos. 4,876,174 (Ishikawa et al), 4,892,804 (Vincent et al), 5,178,992 (Yoshida et al) and 5,354,646 (Kobayashi et al).

Development can also be carried out using what is known in the art as a "developer/amplifier" solution, as described in U.S. Pat. No. 5,324,624 (Twist).

Development is then followed by the use of a bleaching solution as described herein. The bleaching and fixing steps can be carried out in any suitable fashion, as is known in the art. Subsequent to bleaching and fixing, a final washing or stabilizing step may be employed. Color prints and films can be processed using a wide variety of processing protocols, as described for example, in *Research Disclosure*, noted above, and thus can include various combinations of one or more bleaching, fixing, washing or stabilizing steps in various orders, and lastly, drying. Additionally, reversal processes include additional steps of black and white development, chemical fogging, re-exposure and washing prior to color development.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in recently allowed U.S. Ser. No. 08/221,711 (filed Mar. 31, 1994 by Carli et al), now U.S. Pat. No. 5,436,118 and publications noted therein.

The following examples are presented to illustrate the practice of this invention, and are not intended to be limiting in any way. Unless otherwise indicated, all percentages are by weight.

EXAMPLES 1–3

Processing of Color Paper Using Stabilized Bleaching Solutions

Three bleaching solutions of this invention were evaluated for bleaching effectiveness according to the present invention. They were also evaluated for stability. Several comparison bleaching solutions were also evaluated.

The bleaching solutions contained hydrogen peroxide (0.98 mol/l), potassium chloride (0.35 mol/l), potassium carbonate (0.025 mol/l), potassium bicarbonate (0.025 mol/l) and the sequestering agents and amounts listed in Table I below, and were adjusted to pH 10 using potassium hydroxide.

TABLE I

| Sequestering Agent | Control A | Control B | Control C | Control D | Example 1 | Example 2 | Example 3 |
|---|---|---|---|---|---|---|---|
| 1-hydroxyethylidene-1,1-diphosphonic acid | 0.004 mol/l | 0.0 | 0.0 | 0.0 | 0.004 mol/l | 0.004 mol/l | 0.004 mol/l |
| N,N-ethylenediamine disuccinic acid | 0.0 | 0.002 mol/l | 0.0 | 0.0 | 0.002 mol/l | 0.0 | 0.0 |
| N,N-ethylenediamine diacetic acid | 0.0 | 0.0 | 0.002 mol/l | 0.0 | 0.0 | 0.002 mol/l | 0.0 |
| N-(2-carboxyethyl)-aspartic acid | 0.0 | 0.0 | 0.0 | 0.002 mol/l | 0.0 | 0.0 | 0.002 mol/l |

The bleaching solutions described above were evaluated for stability over time. The molar concentration (mol/l) of the peroxide bleaching agent was measured electroanalytically by cyclic voltammetry using a mercury drop electrode. The electroanalytical data were recorded using a conventional EG&G Princeton Applied Research Potentiostat/Galvanostat, Model 273A. The results of these measurements over time are provided in Table II below. Each solution was normalized to 0.98 mol of hydrogen peroxide per liter of solution prior to the first measurement.

TABLE II

| Bleaching Solution | Time (days) Fresh | 7 | 14 | 21 | 28 | 35 |
|---|---|---|---|---|---|---|
| Control A | 0.98 | 0.88 | 0.52 | 0.16 | 0 | 0 |
| Control B | 0.98 | 0 | 0 | 0 | 0 | 0 |
| Control C | 0.98 | 0 | 0 | 0 | 0 | 0 |
| Control D | 0.98 | 0 | 0 | 0 | 0 | 0 |
| Example 1 | 0.98 | 0.80 | 0.76 | 0.68 | 0.67 | 0.58 |
| Example 2 | 0.98 | 0.82 | 0.80 | 0.59 | 0.57 | 0.58 |
| Example 3 | 0.98 | 0.79 | 0.76 | 0.63 | 0.59 | 0.53 |

It can be seen from the data shown in Table II that the three bleaching solutions of this invention retained considerable bleaching activity after 35 days of storage at room temperature. Controls B–D, containing only a polycarboxylic acid, decomposed within a few hours. Control A having a phosphonic acid only, was more stable than the other controls, but decomposed within 21 days.

The bleaching compositions of this invention were also evaluated for bleaching activity after 21 days of storage at room temperature.

Samples of KODAK EKTACOLOR EDGE™ photographic color paper were subjected to a step wedge test object for 1/10 second with HA-50 and NP-11 filters, a 0.3 Inconel and a 3000K color temperature lamp on a conventional 1B-sensitometer. They were then processed using the following protocol (under nitrogen).

| | |
|---|---|
| 45 seconds | Development* |
| 30 seconds | Stop solution (1% v/v $H_2SO_4$) |
| 30 seconds | Water wash |
| 45 seconds | Bleaching |
| 30 seconds | Water wash |
| 1 minute | Fixing** |
| 2 minutes | Water wash |
| 5 minutes | Dry. |

*The developing solution (per liter) was the conventional KODAK EKTACOLOR ™ RA Color Developer.

-continued

**The fixing solution (per liter) was an aqueous solution of sodium metabisulfite (11.8 g) and a solution (162 ml) of ammonium thiosulfate (56.5%) and ammonium sulfite (4%), and had a pH of 6.5.
KODAK PHOTO-FLO ™ is a commercially available rinse.

Residual silver (g/m$^2$) at maximum density was determined by X-ray fluorescence using conventional procedures. The results are tabulated below in Table III after 45 seconds for certain exposure densities. Results are also presented for the use of the conventional KODAK EKTACOLOR™ RA bleach-fixing solution, and for the Control A solution, both freshly prepared. Of course, in the use of the KODAK EKTACOLOR™ RA bleach-fixing solution, the noted fixing and preceding wash steps were omitted from the processing protocol.

TABLE III

| Step Number | RA-4 (g/m$^2$) | Control A (g/m$^2$) | Example 1 (g/m$^2$) | Example 2 (g/m$^2$) | Example 3 (g/m$^2$) |
|---|---|---|---|---|---|
| 1 | 0.05 | 0 | 0.02 | 0.01 | 0 |
| 2 | 0.03 | 0.01 | 0 | 0.01 | 0.01 |
| 3 | 0.04 | 0 | 0.02 | 0 | 0.01 |

TABLE III-continued

| Step Number | RA-4 (g/m²) | Control A (g/m²) | Example 1 (g/m²) | Example 2 (g/m²) | Example 3 (g/m²) |
|---|---|---|---|---|---|
| 11 | 0.01 | 0.01 | 0.02 | 0.02 | 0 |
| 18 | 0.01 | 0 | 0.02 | 0 | 0 |
| 19 | 0.01 | 0.04 | 0.01 | 0.01 | 0 |
| 20 | 0 | 0.01 | 0.01 | 0 | 0 |

The results indicate that the no decline in bleaching performance was observed with the bleaching compositions of this invention after three weeks of storage. In addition, those compositions also provided more complete bleaching of the noted photographic element than the conventional RA-4 bleach-fixing solution that was used freshly prepared. No vesiculation was observed with any of these bleaching compositions.

The results of these experiments indicate that the combination of the two specific acids, a phosphonic acid and a polyaminocarboxylic acid (having at least one secondary amine), in the bleaching composition, provided improved stability and no loss in bleaching performance over the use of the individual acids alone.

The invention has been described in detail with particular reference to preferred embodiments thereof, but it will be understood that variations and modifications can be effected within the spirit and scope of the invention.

We claim:

1. A method for processing a color silver halide photographic element comprising:

bleaching an imagewise exposed and developed color silver halide photographic element with a peroxide bleaching composition having a pH of from about 8 to about 11 and consisting essentially of:

a peroxide bleaching agent, chloride ions present in an amount of at least 0.35 mol/l, a first compound which is an organic phosphonic acid or a salt of said acid with a monovalent cation, and a second compound that is a polyaminocarboxylic acid having at least one secondary amine at said bleaching composition pH, or a salt of said acid with a monovalent cation.

2. The method of claim 1 wherein said bleaching agent is hydrogen peroxide.

3. The method of claim 1 wherein said bleaching solution comprises said chloride ions in an amount of from 0.35 to about 2 mol/l.

4. The method of claim 3 wherein said bleaching solution comprises said chloride ions in an amount of from 0.35 to about 1 mol/l.

5. A peroxide bleaching composition having a pH of from about 8 to about 11 and consisting essentially of:

a peroxide bleaching agent, chloride ions present in an amount of at least 0.35 mol/l, a first compound which is an organic phosphonic acid or a salt of said acid with a monovalent cation, said organic phosphonic acid being 1-hydroxyethylidene-1,1-diphosphonic acid, nitrilo-N,N,N-trimethylenephosphonic acid, or diethylenetriamine-N,N,N',N",N"-penta(methylenephosphonic acid), and a second compound that is a polyaminocarboxylic acid having at least one secondary amine at said bleaching composition pH, or a salt of said acid with a monovalent cation, said polyaminocarboxylic acid being N,N-ethylenediaminedisuccinic acid, N,N-ethylenediamineacetic acid, or N-(2-carboxyethyl)aspartic acid.

6. The method of claim 1 wherein said organic phosphonic acid has the structure (I):

$$R^1N\ (CH_2PO_3M_2)_2$$

or the structure (II):

$$R^2R^3C(PO_3M_2)_2$$

wherein $R^1$ is hydrogen, an alkyl group of 1 to 12 carbon atoms, an alkylaminoalkylene group wherein the alkyl group has 1 to 12 carbon atoms which may be substituted, an alkoxyalkyl group of 1 to 12 carbon atoms, a cycloalkyl group of 5 to 10 carbon atoms, an aryl group of 6 to 10 carbon atoms, or a heterocyclic group having 5 to 10 atoms in the ring, $R^2$ is hydrogen, an alkyl group of 1 to 12 carbon atoms, an aryl group of 6 to 10 carbon atoms, a cycloalkyl group of 5 to 10 carbon atoms, a heterocyclic group having 5 to 10 atoms in the ring, $—PO_3M_2$, or $—CHR^4PO_3M_2$, $R^3$ is hydrogen, hydroxyl, an alkyl group of 1 to 12 carbon atoms or $—PO_3M_2$, $R^4$ is hydrogen, hydroxyl, an alkyl group of 1 to 12 carbon atoms or $—PO_3M_2$, and M is hydrogen or a monovalent cation.

7. The method of claim 6 wherein said organic phosphonic acid thereof is 1-hydroxyethylidene-1,1-diphosphonic acid, nitrilo-N,N,N-trimethylenephosphonic acid, or diethylenetriamine-N-N,N',N",N"-penta(methylenephosphonic acid).

8. The method of claim 1 wherein said organic phosphonic acid or salt of the acid with a monovalent cation is present in an amount of from about 0.0005 to about 0.03 mol/l.

9. The method of claim 8 wherein said organic phosphonic acid or salt of the acid with a monovalent cation is present in an amount of from about 0.0025 to about 0.012 mol/l.

10. The method of claim 1 wherein said second compound has one of the following structures:

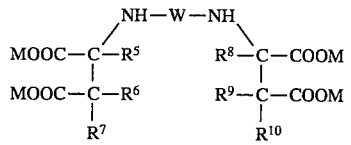

(III)

wherein $R^5$, $R^6$, $R^7$, $R^8$, $R^9$ and $R^{10}$ are independently hydrogen, hydroxy, an alkyl group of 1 to 5 carbon atoms, an cycloalkyl group of 5 to 10 carbon atoms, or an aryl group having 6 to 10 carbon atoms in the aromatic nucleus, M is hydrogen or a monovalent cation, and W is a covalent bond or a divalent aliphatic linking group,

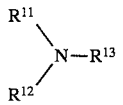

(IV)

wherein at least two of $R^{11}$, $R^{12}$ and $R^{13}$ are carboxymethyl groups, and the third group is hydrogen,

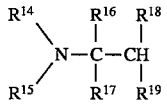

(V)

wherein one of $R^{14}$ and $R^{15}$ is a carboxymethyl or 2-carboxyethyl group, and the other is hydrogen, and $R^{16}$, $R^{17}$, $R^{18}$ and $R^{19}$ are independently hydrogen, an alkyl group of 1 to 5 carbon atoms, hydroxy, carboxymethylamino, carboxy or carboxymethyl, provided that only one of $R^{16}$, $R^{17}$, $R^{18}$ and $R^{19}$ is carboxy, carboxymethylamino or carboxymethyl,

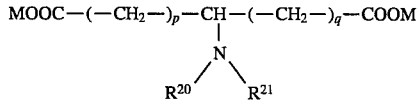

(VI)

wherein one of $R^{20}$ and $R^{21}$ is hydrogen, and the other is an alkyl group of 1 to 5 carbon atoms, a hydroxyethyl group, a carboxymethyl group or a 2-carboxyethyl group, M is as defined above, and p and q are independently 0, 1 or 2 provided that the sum of p and q does not exceed 2, or

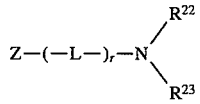

(VII)

wherein

Z represents an aryl group of 6 to 10 carbon atoms in the nucleus or a heterocyclic group having 5 to 7 carbon, nitrogen, sulfur and oxygen atoms in the nucleus, L is a divalent aliphatic linking group, one of $R^{22}$ and $R^{23}$ is hydrogen, and the other is an alkyl group of 1 to 5 carbon atoms, a carboxyalkyl group of 2 to 4 carbon atoms or a hydroxy-substituted carboxyalkyl group of 2 to 4 carbon atoms, and r is 0 or 1.

11. The method of claim 1 wherein said second compound is present in an amount of from about 0.001 to about 0.05 mol/l.

12. The method of claim 10 wherein said second compound is N,N-ethylenediaminedisuccinic acid, N,N-ethylenediaminediacetic acid, N-(2-carboxyethyl)aspartic acid or a salt of one of these acids.

13. The method of claim 1 wherein said photographic element comprises a silver halide emulsion having more than 50 mol % chloride and substantially no iodide.

14. The method of claim 13 wherein said photographic element comprises a silver halide emulsion having more than 90% chloride.

15. The method of claim 1 wherein said bleaching agent is present in an amount of from about 0.15 to about 5 mol/l.

16. A peroxide bleaching composition having a pH of from about 8 to about 11 and consisting essentially of:

a peroxide bleaching agent present in an amount of from about 0.15 to about 5 mol/l, chloride ions present in an amount of at least 0.35 mol/l, a first compound which is an organic phosphonic acid or a salt of the acid with a monovalent cation, and a second compound which is a polyaminocarboxylic acid having at least one secondary amine at the pH of said bleaching composition, or a salt of the acid with a monovalent cation.

17. The composition of claim 16 having a pH of from about 8 to about 11, and wherein said bleaching agent is hydrogen peroxide.

18. The composition of claim 16 wherein said chloride ion is present in an amount of from 0.35 to about 2 mol/l, said first compound is present in an amount of from about 0.0005 to about 0.03 mol/l, and said second compound is present in an amount of from about 0.0005 to about 0.05 mol/l.

19. The composition of claim 16 wherein said organic phosphonic acid has the structure (I):

$$R^1N(CH_2PO_3M_2)_2$$

or the structure (II):

$$R^2R^3C(PO_3M_2)_2$$

wherein $R^1$ is hydrogen, an alkylaminoalkylene group wherein the alkyl group has 1 to 12 carbon atoms which may be substituted, an alkoxyalkyl group of 1 to 12 carbon atoms, a cycloalkyl group of 5 to 10 carbon atoms, an aryl group of 6 to 10 carbon atoms, or a heterocyclic group having 5 to 10 atoms in the ring, $R^2$ is hydrogen, an alkyl group of 1 to 12 carbon atoms, an aryl group of 6 to 10 carbon atoms, a cycloalkyl group of 5 to 10 carbon atoms, a heterocyclic group having 5 to 10 atoms in the ring, $—PO_3M_2$, or $—CHR^4PO_3M_2$, $R^3$ is hydrogen, hydroxyl, an alkyl group of 1 to 12 carbon atoms or $—PO_3M_2$, $R^4$ is hydrogen, hydroxyl, an alkyl group of 1 to 12 carbon atoms or $—PO_3M_2$, and M is hydrogen or a monovalent cation, and said second compound has one of the following structures:

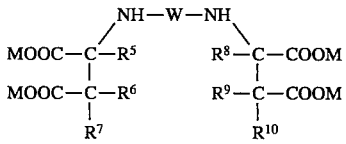

(III)

wherein $R^5$, $R^6$, $R^7$, $R^8$, $R^9$ and $R^{10}$ are independently hydrogen, hydroxy, an alkyl group of 1 to 5 carbon atoms, an cycloalkyl group of 5 to 10 carbon atoms, or an aryl group having 6 to 10 carbon atoms in the aromatic nucleus, M is as defined above, and W is a covalent bond or a divalent aliphatic linking group,

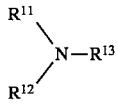

(IV)

wherein at least two of $R^{11}$, $R^{12}$ and $R^{13}$ are carboxymethyl groups , and the third group is hydrogen,

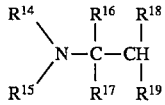

(V)

wherein one of $R^{14}$ and $R^{15}$ is a carboxymethyl or 2-carboxyethyl group and the other is hydrogen, and $R^{16}$, $R^{17}$, $R^{18}$ and $R^{19}$ are independently hydrogen, an alkyl group of 1 to 5 carbon atoms, hydroxy, carboxymethylamino, carboxy or carboxymethyl, provided that only one of $R^{16}$, $R^{17}$, $R^{18}$ and $R^{19}$ is carboxy, carboxymethylamino or carboxymethyl,

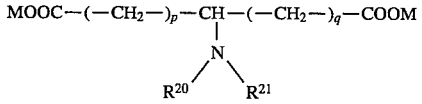

(VI)

wherein one of $R^{20}$ and $R^{21}$ is hydrogen, and the other is an alkyl group of 1 to 5 carbon atoms, a hydroxyethyl group, a carboxymethyl group or a 2-carboxyethyl group, M is as defined above, and p and q are independently 0, 1 or 2 provided that the sum of p and q does not exceed 2, or

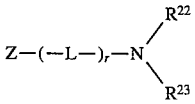

(VII)

wherein

Z represents an aryl group of 6 to 10 carbon atoms in the nucleus or a heterocyclic group having 5 to 7 carbon, nitrogen, sulfur and oxygen atoms in the nucleus, L is a divalent aliphatic linking group, one of $R^{22}$ and $R^{23}$ is hydrogen, and the other is an alkyl group of 1 to 5 carbon atoms, a carboxyalkyl group of 2 to 4 carbon atoms or a hydroxy-substituted carboxyalkyl group of 2 to 4 carbon atoms, and r is 0 or 1.

20. The composition of claim 19 wherein said organic phosphonic acid is 1-hydroxyethylidene-1,1-diphosphonic acid, nitrilo-N,N,N-trimethylenephosphonic acid, diethylenetriamine-N,N,N',N",N"-penta(methylenephosphonic acid), and said second compound is N,N-ethylenediaminedisuccinic acid, N,N-ethylenediamineacetic acid, N-(2-carboxyethyl)aspartic acid, or a salt of any of these acids having a monovalent cation.

21. A method for processing a color silver halide photographic element comprising:

bleaching an imagewise exposed and developed color silver halide photographic element with a peroxide bleaching composition having a pH of from about 8 to about 11 and consisting essentially of:

a peroxide bleaching agent, chloride ions present in an amount of at least 0.35 mol/l, a first compound which is an organic phosphonic acid or a salt of said acid with a monovalent cation, said organic phosphonic acid being 1-hydroxyethylidene-1,1-diphosphonic acid, nitrilo-N,N,N-trimethylenephosphonic acid, or diethylenetriamine-N,N,N',N",N"-penta(methylenephosphonic acid), and a second compound that is a polyaminocarboxylic acid having at least one secondary amine at said bleaching composition pH, or a salt of said acid with a monovalent cation, said polyaminocarboxylic acid being N,N-ethylenediaminedisuccinic acid, N,N-ethylenediamineacetic acid, or N-(2-carboxyethyl)aspartic acid.

* * * * *